US009204704B1

(12) United States Patent
Wolfe

(10) Patent No.: US 9,204,704 B1
(45) Date of Patent: Dec. 8, 2015

(54) BRUSH GRINDER AND BRUSH APPLICATOR DEVICE FOR DELIVERY OF A COSMETIC POWDER

(71) Applicant: Barnett Wolfe, Port Washington, NY (US)

(72) Inventor: Barnett Wolfe, Port Washington, NY (US)

( * ) Notice: Subject to any disclaimer, the term of this patent is extended or adjusted under 35 U.S.C. 154(b) by 0 days.

(21) Appl. No.: 13/957,696

(22) Filed: Aug. 2, 2013

Related U.S. Application Data

(63) Continuation-in-part of application No. 13/953,501, filed on Jul. 29, 2013, now abandoned.

(60) Provisional application No. 61/676,622, filed on Jul. 27, 2012.

(51) Int. Cl.

| | |
|---|---|
| ***A45D 44/18*** | (2006.01) |
| ***A45D 33/02*** | (2006.01) |
| ***A45D 33/00*** | (2006.01) |
| *A46B 11/00* | (2006.01) |

(52) U.S. Cl.
CPC ..... *A45D 33/025* (2013.01); *A45D 33/003* (2013.01); *A45D 33/02* (2013.01); *A46B 11/0006* (2013.01); *A46B 2200/1046* (2013.01)

(58) Field of Classification Search
CPC ..... A46B 2200/1046; A46B 2200/10; A46B 11/0006; A46B 11/001; A46B 11/0013; A46B 11/0062; A45D 33/003; A45D 33/025; A45D 33/02; A45D 33/08; A45D 33/10; A45D 33/00; A45D 33/006
USPC ..... 132/313, 289, 290, 293, 294, 297, 298, 132/299, 300, 305, 306, 307, 314, 317, 318, 132/320; 206/581, 823; 220/370, 371, 372; 222/189.02, 189.03, 189.06, 189.05, 222/480, 142.9, 564, 241, 342, 548, 565, 222/235, 546; 209/371, 397; 401/4, 280, 401/281, 291; 241/79.2, 79.3, 91, 169.1, 241/168, 170
See application file for complete search history.

(56) References Cited

U.S. PATENT DOCUMENTS

| | | | | | |
|---|---|---|---|---|---|
| 1,835,249 | A | * | 12/1931 | Vicki | 132/298 |
| 2,067,756 | A | * | 1/1937 | Espinosa | 401/40 |
| 3,167,806 | A | * | 2/1965 | Hogan | 401/286 |
| 4,280,666 | A | * | 7/1981 | Jones | 241/169.1 |
| 4,427,138 | A | * | 1/1984 | Heinlein | 222/546 |
| 4,652,162 | A | * | 3/1987 | Ladd et al. | 401/123 |
| 4,666,068 | A | * | 5/1987 | Bush | 222/546 |
| 4,728,211 | A | * | 3/1988 | Ladd, Jr. | 401/123 |
| 4,944,625 | A | * | 7/1990 | Futter et al. | 401/153 |

(Continued)

*Primary Examiner* — Vanitha Elgart
(74) *Attorney, Agent, or Firm* — Thomas A. O'Rourke; Bodner & O'Rourke, LLP

(57) ABSTRACT

A powder applicator includes a base housing with a protruding brush and an opening into a cavity for storing powder beads. A body housing opening creates a chamber that transitions into a chute having a second smaller opening for delivery of powder. A filter partitions the chamber into grinding and delivery chambers, which are interconnected by selectively sized holes therein. Bristles of an applicator brush are secured about the chute. The base housing is rotatably secured to the body housing, with the first brush extending into the grinding chamber to thereby grind powder beads received therein into a powder. The first brush contacts the filter member and causes doffing of formed powder through the holes and into the delivery chamber. A cap having a cantilevered post snaps onto the body housing to protect the applicator brush when not in use, with the post's end plugging the delivery opening.

11 Claims, 12 Drawing Sheets

(56) References Cited

U.S. PATENT DOCUMENTS

| | | | | |
|---|---|---|---|---|
| 4,961,521 | A * | 10/1990 | Eckman | 222/142.5 |
| 5,339,483 | A | 8/1994 | Byun | |
| 6,039,051 | A * | 3/2000 | Dorf | 132/313 |
| 6,224,287 | B1 | 5/2001 | Gieux | |
| 6,283,339 | B1 * | 9/2001 | Morrow | 222/452 |
| 6,659,379 | B2 | 12/2003 | Chen | |
| 6,755,585 | B2 * | 6/2004 | Gueret | 401/125 |
| 6,932,533 | B1 | 8/2005 | Chen | |
| 7,234,474 | B2 * | 6/2007 | Byun | 132/313 |
| 7,275,885 | B2 | 10/2007 | Byun | |
| 7,503,331 | B2 * | 3/2009 | Eng et al. | 132/294 |
| 7,669,606 | B2 * | 3/2010 | Byun | 132/299 |
| 7,775,737 | B2 | 8/2010 | Deans | |
| 7,975,943 | B1 | 7/2011 | Culves | |
| 8,066,019 | B2 | 11/2011 | Zhu | |
| 8,210,187 | B1 | 7/2012 | Zhang | |
| 8,286,648 | B2 * | 10/2012 | Thorpe et al. | 132/307 |
| 8,387,627 | B2 * | 3/2013 | Yeom | 132/307 |
| 8,839,803 | B2 * | 9/2014 | Holloway | 132/307 |
| 2002/0040720 | A1 * | 4/2002 | Byun | 132/112 |
| 2004/0118426 | A1 * | 6/2004 | Jang | 132/313 |
| 2005/0175397 | A1 * | 8/2005 | Chen | 401/281 |
| 2007/0199959 | A1 * | 8/2007 | Getsy | 222/480 |
| 2009/0123217 | A1 * | 5/2009 | Ross | 401/134 |
| 2011/0048443 | A1 * | 3/2011 | Pires et al. | 132/200 |

* cited by examiner

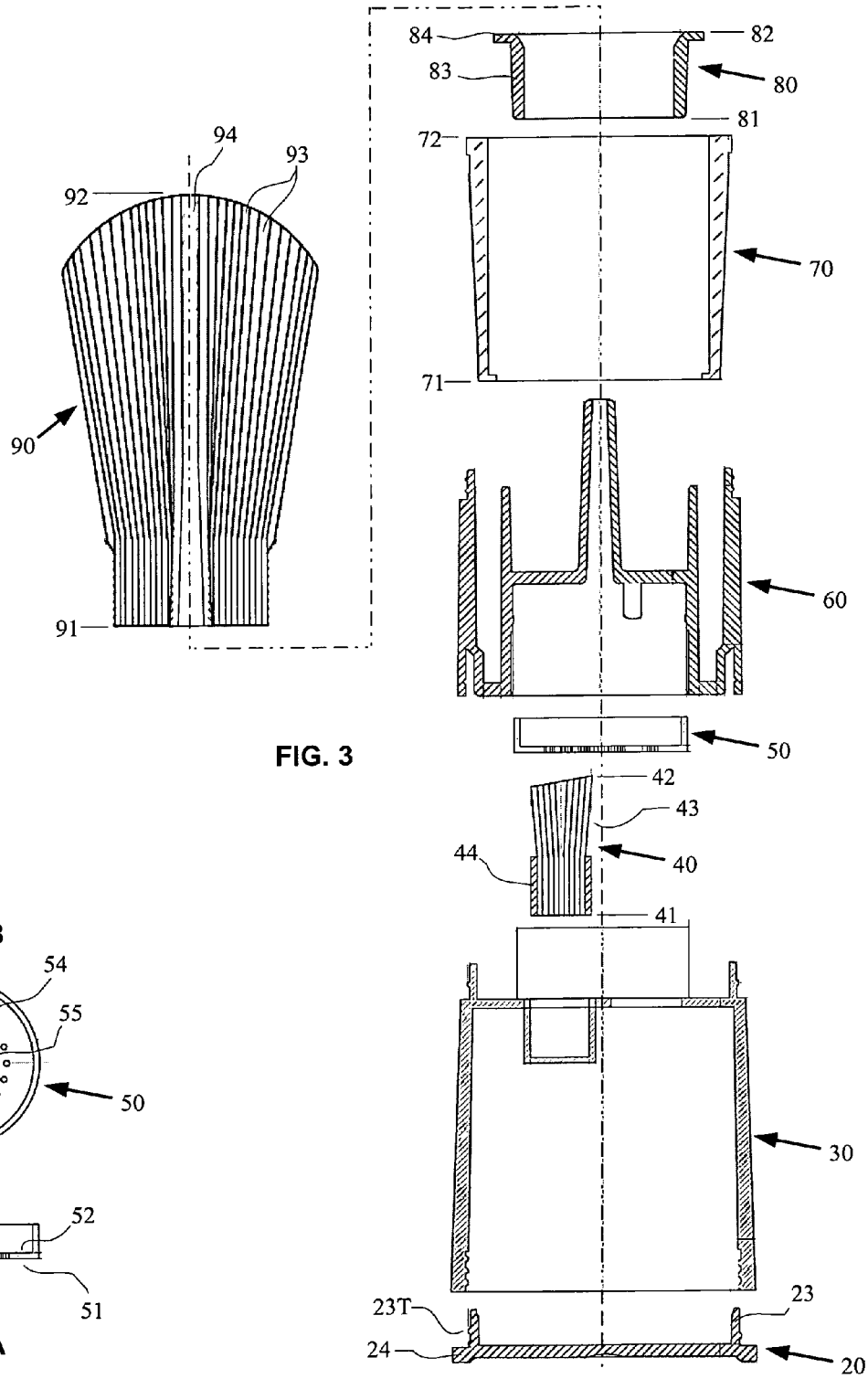
FIG. 3
FIG. 4B
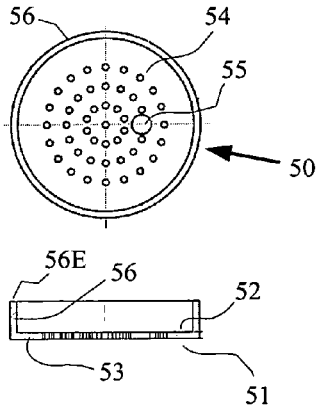
FIG. 4A

FIG. 6
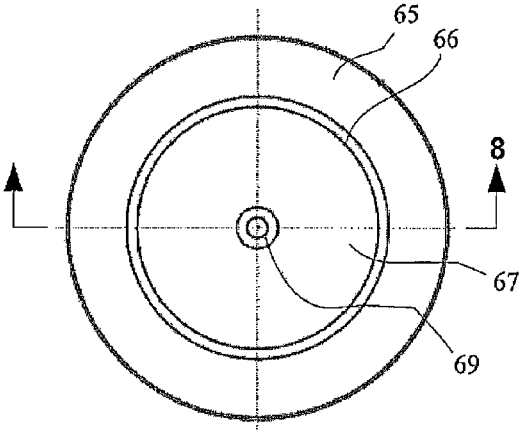
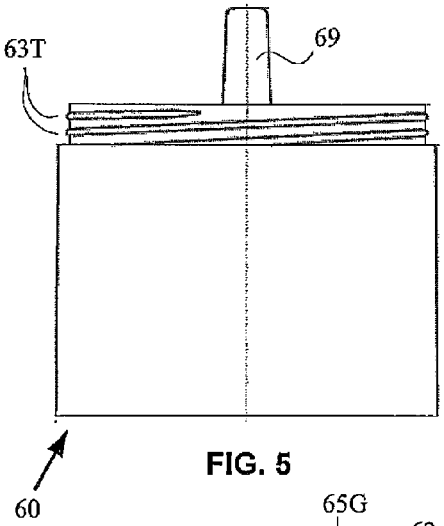
FIG. 5
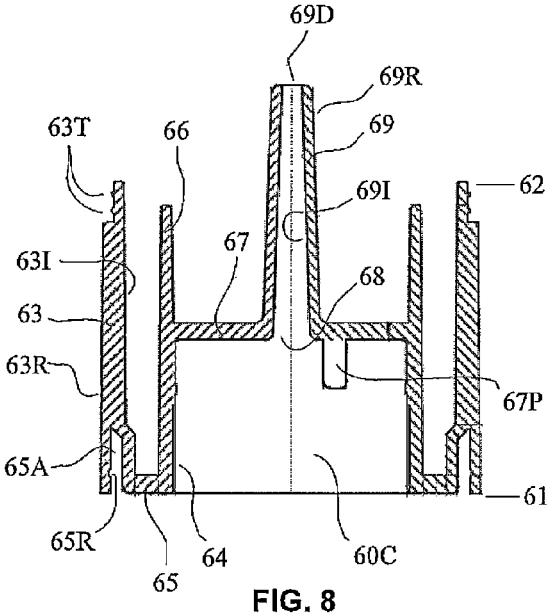
FIG. 8
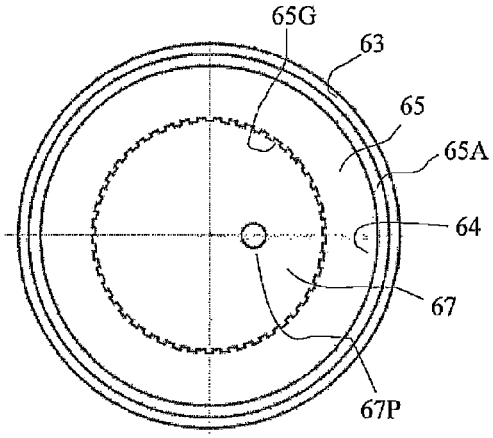
FIG. 7

FIG. 10
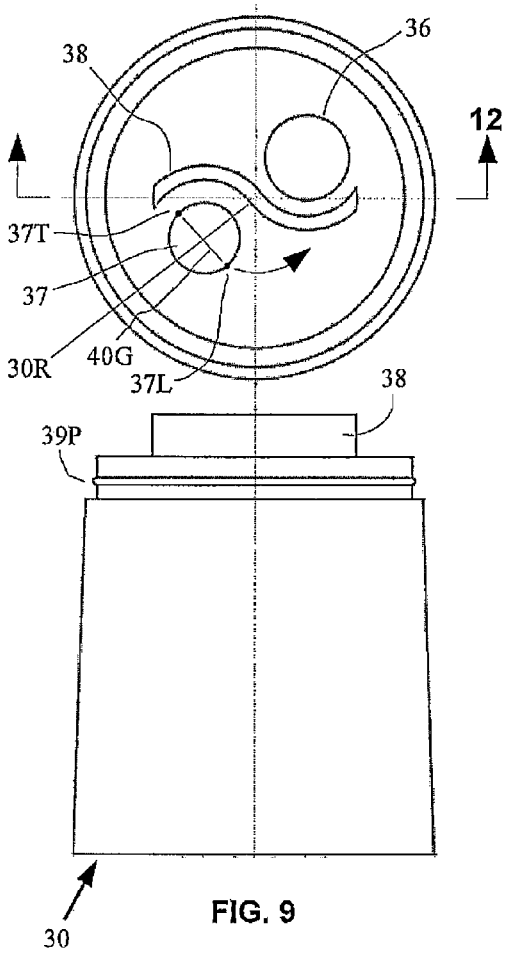
FIG. 9
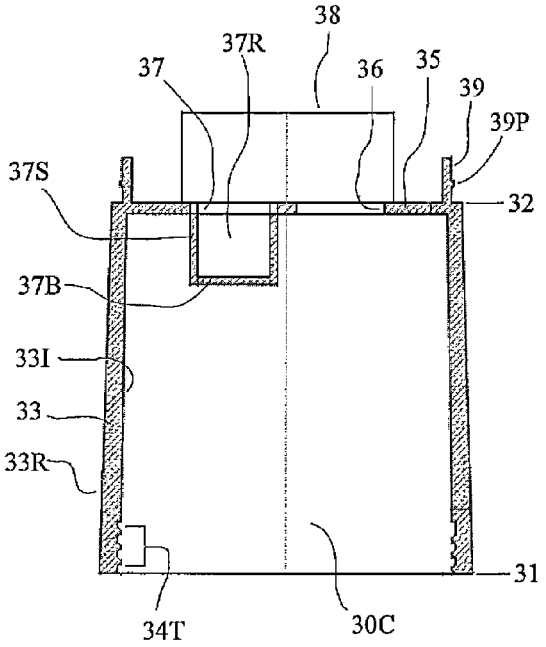
FIG. 12
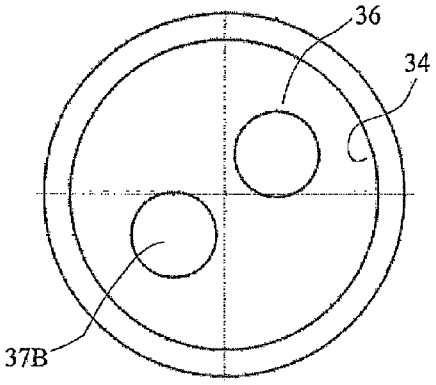
FIG. 11

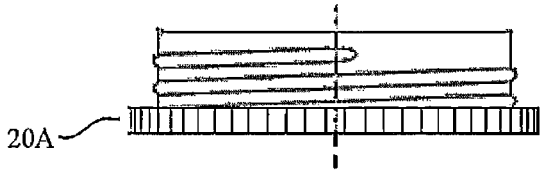
FIG. 16F
FIG. 16D
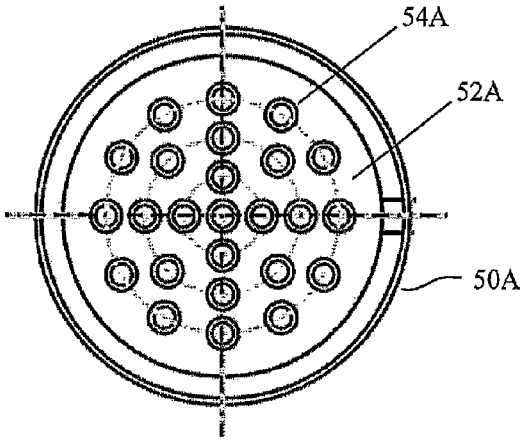
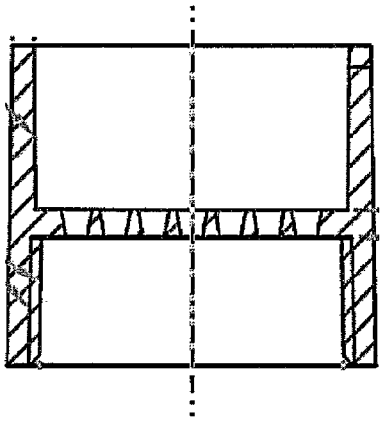
FIG. 16E

BRUSH GRINDER AND BRUSH APPLICATOR DEVICE FOR DELIVERY OF A COSMETIC POWDER

CROSS REFERENCES TO RELATED APPLICATIONS

This application claims priority on U.S. Provisional Application Ser. No. 61/676,622 filed on Jul. 27, 2012 and U.S. application Ser. No. 13/953,501 filed Jul. 29, 2013, the disclosures of which are incorporated herein by reference.

FIELD OF THE INVENTION

The present invention relates to improvements in cosmetic powder dispensers, and more particularly to an apparatus which is capable of on-demand production of powder from beads of processed powder that may be in the form of balls, with contemporaneous or subsequent dispensing of the powder.

BACKGROUND OF THE INVENTION

Cosmetic powders today serve many different functions. A face powder may be applied to give a smooth sheen to the wearer's skin, and may serve as a foundation. It may be translucent, or may alternatively be pigmented to match the skin tone of the user. Cosmetic powder may also comprise sunscreen to protect against damage to underlying skin from exposure to sunlight. These powders may also absorb oils from the skin and prevent the appearance of shiny patches, and may furthermore conceal open pores.

Cosmetic powders are available for application as a compact that contains pressed powder, or as a loose powder in a container. However, uniform distribution of the cosmetic upon the user's face is more easily achieved through the application of a loose powder. Many producers of a cosmetic powder will market their products by housing the powder in a separate container, into which a brush may be dipped to withdraw an uncertain amount of the product. Since these cosmetic products are expensive, a number of inventions have been developed to attempt to provide for the controlled and/or metered dispensing of the powder. These inventions typically comprise a chamber for housing the loose powder, and some means of dispensing the powder.

U.S. Pat. No. 6,224,287 to Gieux for "Powder Dispensing Brush for Cosmetic Use" includes a powder reservoir having tufts of hairs secured thereto using a sleeve, with the powder being permitted to migrate from the reservoir to the hair by at least one passage therebetween. However, this does not inhibit or limit the transmission of powder from the reservoir to the hairs, and can become quite messy.

U.S. Pat. No. 6,932,533 to Chen for "Cosmetic Container for Controlling Powder Flow Rate" provides better control over the flow of the powder. The Chen device comprises a container body for storing the powder, and has a pair of corresponding guiding slots on an end, with the container body being rotatably secured to a brush body that has a pair of corresponding outlet slots that may align with the guiding slots for a portion of the rotation between the two members, to permit the transfer of powder therebetween and onto the brush. So, powder is only transferred to the brush when some portion of the guiding slots and outlet slots are aligned. But the user does not have a visual cue as to when they are or are not aligned, as they are internal, and thus the user does not have positive control over the timing and amount of powder permitted to escape from the container body. Thus, the user may unintentionally store the unit while the slots are aligned leading to an excessive expulsion of powder onto the brush, much of which may be wasted.

U.S. Pat. No. 7,275,885 to Byun for "Cosmetic Brush" discloses a device that stores powder in a body, and by actuating a push-button that moves a spring-biased rod, the rod causes powder to flow through an inlet hole and an outlet hole of a powder transfer tube, for delivery of the powder in a constant amount onto a brush. Therefore, the Byun device, by transmitting a constant amount of powder with each cycling of the button, offers an improvement over the prior art powder dispensers, which were messy and less efficient. The present invention addresses the drawbacks of the prior art in a different manner, which furthermore permits the user the choice of a limited incremental transmission of powder, or of storing a medium or large quantity of powder for a more substantial and immediate application, or a later application.

OBJECTS OF THE INVENTION

It is an object of the invention to provide a dispenser usable for the dispensing of a cosmetic powder.

It is another object of the invention to provide a dispenser that is capable of delivering a small amount of a cosmetic powder onto a brush applicator.

It is a further object of the invention to provide a dispenser that is capable of alternately delivering a medium to a large amount of cosmetic powder onto a brush applicator.

It is another object of the invention to provide a dispenser that stores cosmetic powder in a bead of processed powder that may be in the form of spherical balls for a more aesthetic appearance.

It is also an object of the invention to provide a dispenser that is capable of crushing and grinding powder beads into a powder for on-demand availability to the user.

Further objects and advantages of the invention will become apparent from the following description and claims, and from the accompanying drawings.

SUMMARY OF THE INVENTION

A dispenser for applying a cosmetic powder may comprise a base housing having a first end and a second end with a cavity therebetween. A large opening in the first end may be usable to receive a plurality of powder beads for storage in the cavity. The first end of the housing may receive a bottom cover to releasably secure the large opening, which may be subsequently accessed to add powder beads when needed. The cover may snap into the housing, or may be threadably received therein. The second end of the housing may have a small orifice to permit egress of one or more powder beads when needed. Protruding from the second end of the base housing may be a first brush. The first brush may comprise a plurality of bristles having a first end secured in a retaining ring, with the bristles extending therefrom to be generally unrestricted in terms of movement, other than the stiffness of the tuft of bristles secured by the ring. The ring of the bristles may be fixed within a portion of the second end of the base housing, with the second end of the plurality of bristles protruding away from the second end of the base housing.

The dispenser may also comprise a body housing that is rotatably secured to the base housing. The body housing may have a large opening on one end that creates a chamber that transitions into a chute having a second smaller opening thereat for delivery of powder. A filter member is received through the large opening to partition the chamber into a grinding chamber and a delivery chamber, with the delivery chamber being proximal to the chute and small delivery opening, and the grinding chamber being proximal to the large opening The grinding chamber and the delivery chamber are interconnected by selectively sized holes in the filter member. The plurality of selectively sized holes of the filter member may preferably admit particles having a rough size of 1 mm or smaller. When the base housing is rotatably secured to the body housing, the first brush will extend into the grinding chamber, and the small orifice at the second end of the base housing will face the grinding chamber to admit powder beads therein as they egress from the storage cavity. The first brush may be positioned in the second end of the base housing so as to have an axis that is off-set from the rotational axis of the joined base and body housings. A serpentine-shaped stiffener may extend from the second end of the base housing, with the stiffener extending into a portion of the grinding chamber to be proximate to the filter member but be displaced therefrom, and with a first side of the serpentine-shaped stiffener curving around the second brush, and a second side of the stiffener curving around the small orifice at the second end of the base housing.

As the user rotates the base housing relative to the body housing, the powder beads that had been admitted into the grinding chamber from the storage cavity, will be crushed and ground into a powder, to an extent dictated by the amount of rotation caused by the user. As powder is formed, the bristle ends of the first brush, which may be in contact with the filter member, may cause doffing of the formed powder through the holes and into the delivery chamber. Only crushed powder particles, since they are smaller than the selectively sized holes, may therefore be admitted into the delivery chamber.

The dispenser may also comprise a plurality of bristles forming a second brush usable for application of the powder, which may be fixedly secured peripherally about the delivery opening of the body housing's chute, which may be conically shaped. The bristles of the second brush may be secured thereto using adhesive and/or a bristle retention sleeve.

The bristles of the delivery brush may be protected by a cap when the dispenser is not in use. The cap may snap onto and off of the body housing, to protect the applicator brush, and may further comprise a cantilevered post, with an end of the post serving to plug the delivery opening when the cap is on the dispenser, to retain any ground powder contained therein when the dispenser is not being used. A bristle shield may be slidably retained upon the body housing to be slidable between a retracted position and an extended position, the extended position being where a first end of the bristle shield, during sliding from the first position, contacts and gathers the plurality of bristles of the second brush. The bristle shield may thus serve to gather the bristles of the second brush in order to more easily permit the cap to be placed upon the body housing, without causing damage to the outermost of the periphery of bristles.

The user may choose to only grind as much powder as is needed for a small single application, or the user may grind a larger amount of powder either for a single large application or for a small application with the intent to just retain some powder in the dispensing chamber for use at a later time. The user may thus control how much powder is collected within the delivery chamber at any given time by the amount of base-to-body housing rotation that is caused.

BRIEF DESCRIPTION OF THE DRAWINGS

FIG. 3 is an exploded view of the parts comprising the brush grinder and brush applicator dispenser of FIG. 1.

FIG. 4A is the end view of the filter member of FIG. 3.

FIG. 4B is a bottom view of the filter member of FIG. 4A.

FIG. 5 is a side view of the body housing of the brush grinder and brush applicator device of FIG. 1.

FIG. 6 is a top view of the body housing of FIG. 5.

FIG. 7 is a bottom view of the body housing of FIG. 5.

FIG. 8 is a cross-sectional view through the body housing of FIG. 6.

FIG. 9 is a side view of the base housing of the brush grinder and brush applicator device of FIG. 1.

FIG. 10 is a top view of the base housing of FIG. 9.

FIG. 11 is a bottom view of the base housing of FIG. 9.

FIG. 12 is a cross-sectional view through the base housing of FIG. 10.

FIG. 16D shows a bottom view of an alternate embodiment of the filter member that is used in the dispenser of FIG. 16A.

FIG. 16E is a side cross-sectional view of the filter member of FIG. 16D.

FIG. 16F is a side view of the cap used on the filter member of FIG. 16E.

DETAILED DESCRIPTION OF THE INVENTION

Figure 1:
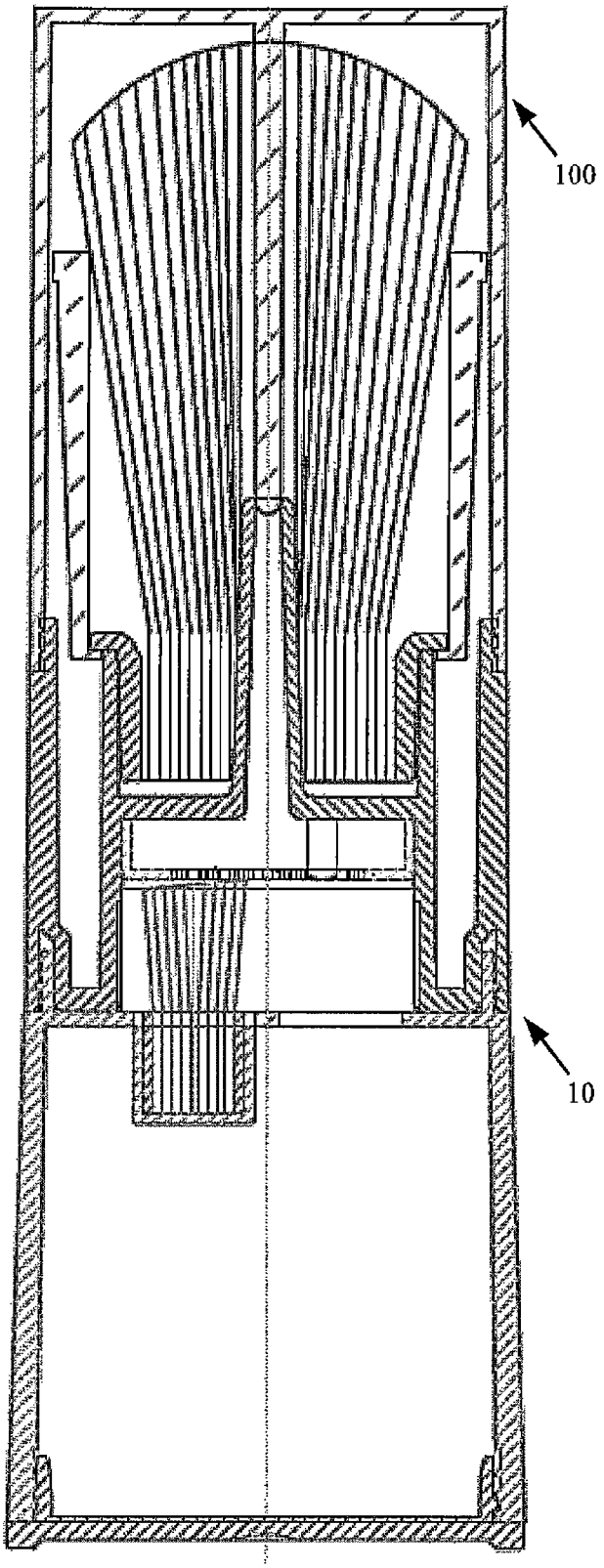
FIG. 1 is a side view of the brush grinder and brush applicator device of the present invention and a corresponding cap, with the bristle shield of the device shown in the extended position.
Figure 2:
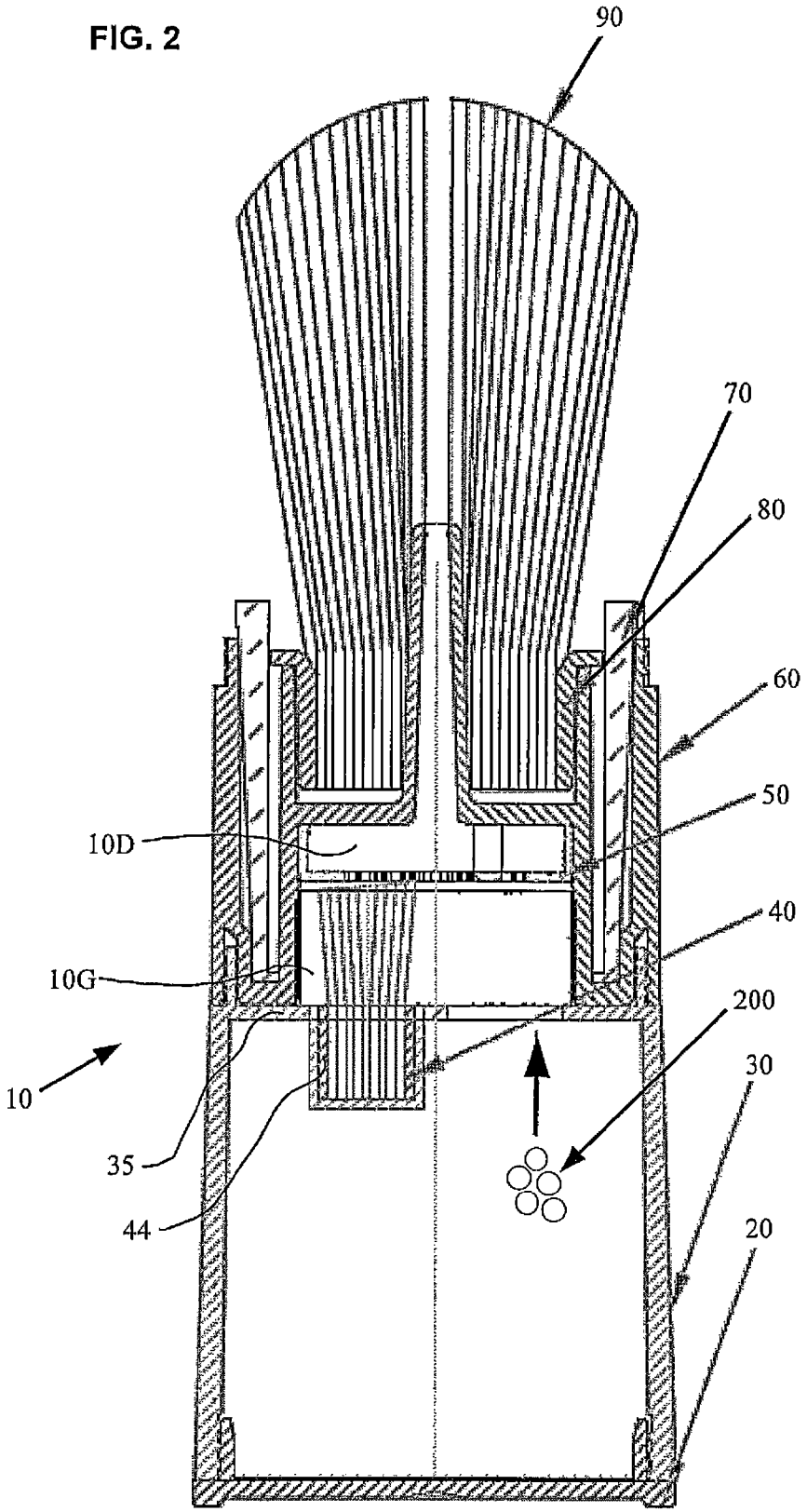
FIG. 2 is the dispenser of FIG. 1, but shown with the cap removed and the bristle shield being in the retracted position.

FIG. 1 shows the dispenser 10 of the present invention, which may have a cap 100 secured thereon to protect the bristles of the applicator brush, when the dispenser is not being used. FIG. 2 shows the dispenser 10 without the cap being secured thereon. Operation of the dispenser 10 may best be understood through a discussion of its component parts, which are seen within the exploded view of FIG. 3. Not all of the parts illustrated in FIG. 3 are necessary for the primary functioning of the dispenser 10, as will be discussed hereinafter. As seen in FIG. 3, the dispenser 10 may comprise: a bottom cover 20, a base housing 30, a first bristle brush 40, a filter member 50, a body housing 60, a bristle shield 70, a bristle retaining ring 80, and a second bristle brush 90.

The base housing 30 is shown in more detail throughout FIGS. 9-12. The base housing 30 may be formed into any suitable shape, such as an irregular shape or a regular shape, including, but not limited to, one having a rectangular cross-section, one having a pentagonal cross-section, a hexagonal cross-section, an octagonal cross-section, or one having a cylindrical shape, or a conical shape, etc. Merely to be exemplary, the base housing 30 illustrated throughout the drawing figures is generally shown as having a conical shape. As seen in FIG. 12, the conical portion of base housing 30 may extend from a first end 31 to a second end 32, and may comprise a conical wall 33 having an outer surface 33R and an inner surface 331. The first end 31 of the base housing 30 may have a large opening 34 into the inner surface 331 of conical wall 33, while the second end 32 of the base housing 30 may have a generally flat wall 35 that forms a storage cavity 30C within the base housing. The opening 34 in the base housing may be releasably secured using a cover member 20. The cover member 20 may be adapted to fit into opening 34 in a friction fit, or it may be adapted to snap into the opening, or alternatively, the opening 34 may comprise a series of internal threads 34T that may be releasably engaged by a series of external threads 23T that are located on a cylindrical protrusion 23 of cover member 20 (FIG. 3). The cover member 20 may comprise a wall 24 having sufficient depth so as to permit a user to grasp it with a hand and cause it to either rotate clockwise or rotate counterclockwise, to thereby cause its respective engagement with or disengagement from the opening 34 of base housing 30.

At the second end 32 of base housing 30 may be a smaller opening 36 that also penetrates into the storage cavity 30C, which may be in the wall 35. The opening 36 may be sized to permit egress of powder beads 200 (FIG. 2) from the storage cavity 30C, which may be stored therein, as discussed hereinafter. The powder beads 200 may approximate a spherical shape, or a box-shape, or any other suitable geometric shape. The beads may be prepared from bulk powder of a particular texture that is worked in a mixer similar to the one used to produce candy. During the mixing process, a small amount of power is added and then a water based solution is sprayed on the powder. At the end of the mixing process, when the beads have reached the desired diameter, they are next cooked in a cosmetic oven.

Another opening in wall 35—opening 37—may be utilized for retention by the base housing 30 of a first bristle brush—grinder/sweeper brush 40. As seen in FIG. 3, grinder/sweeper brush 40 may comprise a plurality of bristles 43 beginning at a first end 41 and terminating at or proximate to a second end 42. This plurality of bristles may be secured to the body housing 30 utilizing a number of different methods. For example, the plurality of bristles 43 may be inserted through opening 37 in base housing 30 and be bonded thereto using an adhesive or epoxy. Alternatively, the opening 37 in base housing 30 may open into a recess 37R formed by one or more sidewalls 37S and a bottom wall 37B, while the plurality of bristles 43 may be banded together using band member 44, with the banded bristle brush being received through the opening 37 into the recess 37R, as seen in FIG. 1. The band of bristles may be retained therein using any suitable means, including, but not limited to, a friction fit, an adhesive, one or more mechanical fasteners, etc. It should be noted that although opening 37 is shown to be circular in FIG. 10, corresponding to a circular cross-section for the grinder/sweeper brush 40, the opening 37 may alternatively be square with a corresponding square-shaped grinder/sweeper brush, or the opening 37 may be formed to other geometric shapes as well, including, but not limited to, an elongated rectangular shape, a triangular shape, etc.

At the second end 32 of base housing 30 may also be a serpentine shaped stiffener 38 that may extend away from wall 35. A first curved portion of the serpentine-shaped stiffener 38 may curve around opening 37 and around the grinder/sweeper brush 40 (FIG. 10), and, on the opposite side of the inflection point of the serpentine-shaped stiffener, a second curved portion may curve around the opening 36. Also extending away from wall 35 may be a cylinder 39, which may comprise an annular protrusion 39P that may be used to engage the body housing 60, as discussed hereinafter.

The body housing 60, just like the base housing, may comprise any suitable exterior shape, which need not necessarily match the exterior shape of the base housing. The body housing 60 is seen in detail throughout FIGS. 5-8. Merely to be exemplary, the body housing 60 illustrated throughout the drawing figures is generally shown as having a cylindrical shape. As seen in FIG. 12, body housing 60 may have a cylindrical wall 63 that may extend from a first end 61 to a second end 62, and may have an outer surface 63R and an inner surface 631. The cylindrical wall 63 at the second end 62 may comprise a series of external threads 63T.

The first end 61 of the body housing 60 may have a generally flat end wall 65, which may begin at first end 61 and have a thickness extending in the direction of second end 62. A small annular opening 65A may be formed in the end wall 65 and may extend into a portion of the outer cylindrical wall 63, which may thicken locally about the opening 65A. Formed within the opening 65A may be an annular recess 65R that may extend outward toward the outer surface 63R of cylindrical wall 63. The annular opening 65A and recess 65R may be used for mating of the body housing 60 with the base housing 30, as discussed hereinafter. A large cylindrical opening 64 in the end wall 65 forms a chamber 60C within the body housing, as an inner cylinder 66 with an inner diameter matching that of opening 64 may extend away from end wall 65 towards second end 62. Inner cylinder 66 may be bifurcated by a wall 67. The wall 67 may have a small central opening 68 into a hollow conical protrusion 69 that extends away from the wall 67 towards and beyond second end 62. The hollow conical protrusion 69 may thus have an outer surface 69R and an inner surface 691 that terminates at a delivery opening 69D. Protruding from wall 67 into the chamber 60C may be a post 67P.

As seen in FIG. 3, the dispenser 10 of the present invention may comprise a filter member 50. The Filter member 50 may comprise a generally flat plate 53 (FIG. 4A-4B), having a first side 51 and a second side 52. The first and second sides of the filter member 50 may be interconnected by a plurality of selectively sized holes 54 that may be regularly spaced about the plate 53. A hole 55 sized to match the post 67P of body housing 60 may also be located therein. The periphery of the plate 53 may be contoured to match the cross-sectional shape of the chamber 60C formed in body housing 60 by opening 64, and may preferably be circular due to the relative rotational motion that is to be imparted between the base housing 30 and body housing 60. Extending from the periphery of plate 53 may be a hollow cylinder 56.

The filter member 50 may be received in chamber 60C of body housing 60, with the cylindrical wall 56 of the filter sliding through opening 64 of the body housing, until the end of the cylinder 56E, being opposite the plate 53, contacts the wall 67, as seen in FIG. 2. The final positioning of the filter member 50 may also be accomplished with the post 67P of the body housing being received within the hole 55 in plate 53 of the filter 50. The filter member 50 may be retained in this position using one or more fastening methods, including, but not limited to, the use of a friction fit therebetween, or the use of an adhesive, or the use of mechanical fasteners. Receiving the filter member 50 within the chamber 60C of the body housing in this manner serves to partition the chamber into a grinding chamber 10G, and a delivery chamber 10D, the significance of which is discussed further hereinafter.

A second brush 90, as seen in FIG. 3, may comprise a plurality of bristles 93 that may be generally arranged into a ring shape, so as to have an open central portion 94. These bristles 93 may be secured together to form a cohesive arrangement by using epoxy or adhesive at the base of the brush, proximate to first end 91. The bristles of brush 90 may then be received by the body housing, with the hollow conical protrusion 69 of the body housing being received through the open center portion 94 of the brush 90, so that the bristles may be distributed peripherally about the outer surface 69R of the conical protrusion 69, and about its delivery opening 69D. The brush 90 may be formed in several ways other than the one described above. The bristles 93 may alternatively (or additionally) be secured within a bristle retaining ring 80, which may, as seen in FIG. 3, comprise a generally cylindrical member 83 that extends from a first end 81 to a second end 82. At the second end 82 of the bristle retaining ring 80, a flange 84 may extend radially outward from the axis of the cylinder 83. The plurality of bristles 93 being secured first within the bristle retaining ring 80, may aid in more easily forming the desired cohesive shape of brush 90, and may also assist in the receiving of the bristles over the hollow conical protrusion 69 of the body housing during assembly of the dispenser 10.

Once the filter member 50 has been secured within chamber 60C of body housing 60 to form the grinding and delivery chambers 10G and 10D, and once the grinder/sweeper brush 40 has been secured within the opening 37 of the base housing 30, the body housing 60 and the base housing 30 may be rotatably connected. The rotatable connection may be provided by receiving the annular protrusion 39P of the hollow cylinder 39 of base housing 30, within the annular recess 65R within the opening 65A of the body housing 60, as seen in FIG. 2.

Figure 14C:
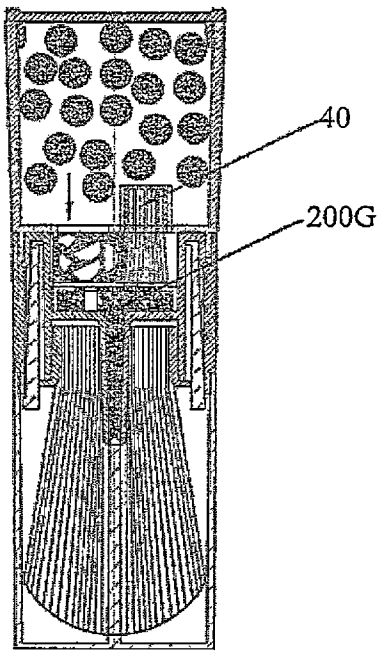
FIG. 14C is the cross-sectional view of FIG. 14B, illustrating grinding of the crushed powder beads in the grinding chamber by the continued rotation of the brush grinder, to produce powder.
Figure 14B:
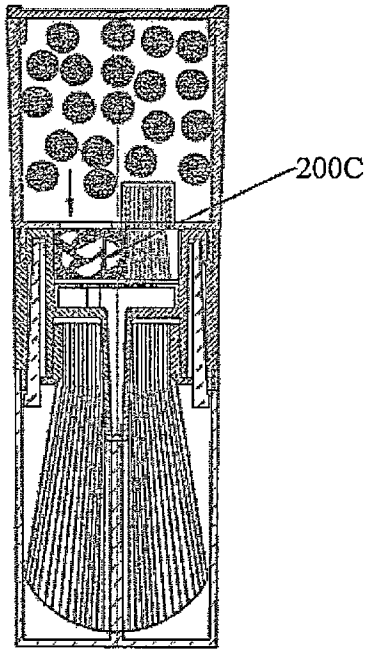
FIG. 14B is the cross-sectional view of FIG. 14A, illustrating crushing of the powder beads in the grinding chamber by the brush grinder.
Figure 14A:
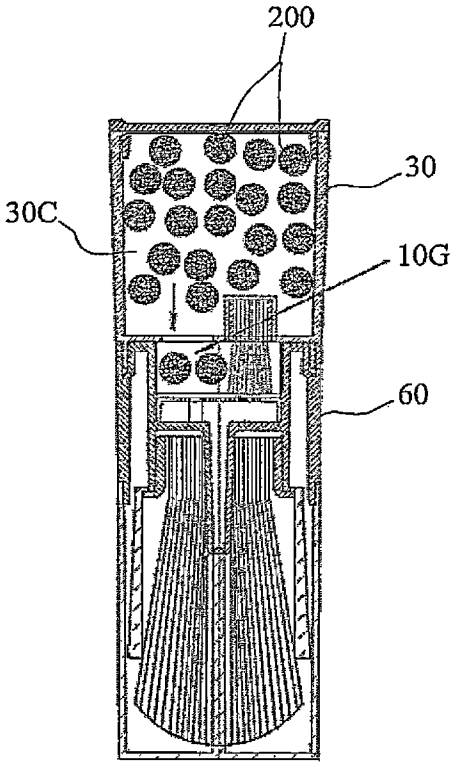
FIG. 14A is a cross-sectional view illustrating movement of powder beads into the grinding chamber of the brush grinder and brush applicator device of FIG. 1.

With the dispenser 10 assembled as seen within FIG. 2, a plurality of powder beads 200 may be loaded into the storage cavity 30C of base housing 30, which may be made of a clear plastic material to provide for an aesthetically appealing appearance for the dispenser. During operation of the dispenser 10, the powder beads 200 may freely egress from storage cavity 30C through the opening 36 in the body housing 30, to enter the grinding chamber 10G, as seen in FIG. 14A. As the user of the dispenser starts to cause rotation of the base housing 30 relative to the body housing 60, with the base housing rotating in a clock-wise direction when looking down upon the base housing, the grinder/sweeper brush 40 engages the powder beads 200 and initially cause crushing of the beads within the grinding chamber 10G, as seen within FIG. 14B, from contact with at least the side of the plurality of bristles 43 of brush 40.

Continuing to cause the clockwise rotation of the base housing 30 relative to the body housing 60 results in further engagement by the brush with the crushed beads 200C, which may, as the size of the bead fragments decrease, occur in proximity to where the second end 42 of the bristles may make contact with the first side 51 of the plate 53 of filter member 50. Such continued engagement and agitation of the fragment by the bristles may cause the size of the fragments to further decrease until the brush has caused the fragments to be reduced to a sufficiently small particle size for the desired powder. The plurality of selectively sized holes 54 in the filter member may be specifically sized to produce the ground particles 200G with each having an appropriate size for a given composition of powder. As an example, each of the selectively sized holes 54 in the filter member may have a diameter of 1 mm. In this example, as the size of the fragments is reduced to reach 1 mm or less, the grinder/sweeper brush 40 may serve its other function, which may be to sweep or doff the particles into the holes 54, causing them to be transferred from the first side 51 of the filter member 50 in the grinding chamber 10G, beyond the second side 52 of the filter to be within the delivery chamber 10D and within the hollow conical protrusion 69, as seen in FIG. 14C. Such doffing/sweeping may also serve to prevent clogging of the holes in the filter member 50.

The grinder/sweeper brush 40 serves multiple functions, and may thus be particularly adapted to optimally serve in its different roles. In one embodiment for the grinder/sweeper brush 40, each of the bristles 43 may extend to the second end 42, so that each of the bristles may therefore contact the first side 51 of the filter member 50 in the grinding chamber 10G, as seen in FIG. 14A. Alternatively, the bristles ends may be shaved to form a plane that may be angled with respect to second end 42, so that on one side of the brush, some of the bristles may reach second end 42, but on the opposite side of the brush, the bristles remain displaced from second end 42, as seen for brush 40 in FIG. 3. Rather than being trimmed to have tapering lengths for the bristles, different length bristles may initially be used to form the brush.

In looking at FIG. 10, and presuming, for the purpose of illustrating the impact of the bristle lengths on the operation of the dispenser, that the grinder/sweeper brush 40 has been installed in opening 37 shown therein, where the free bristles ends would rise out of the page, the leading edge bristles of the brush 40 (denoted therein by 37L) may preferably comprise the shorter side of the brush (shorter bristles), and the trailing edge bristles of the brush 40 (denoted therein by 37T) may preferably comprise the longer side of the brush (longer bristles) that may contact the first side 51 of the filter member 50. Note that the gradient direction 40G for the taper on the ends of the bristles may generally be perpendicular to the radial 30R of the rotating housing (i.e., be generally facing the oncoming beads to thereby capture them in the taper and drag them along). Also note that the brush need not have a circular cross-section, as shown therein, and may be rectangular, and may also extend laterally to be in closer proximity to the serpentine wall, and may extend laterally in the opposite direction to be in closer proximity to cylinder 39.

Therefore, the extent of the angle of the shaved/tapered plane defining the bristle ends, which causes the height of the leading edge bristle ends to be displaced from the first side 51 of filter member 50, may be calibrated according to the size of the powder beads that may be used in the dispenser. The shorter and medium length bristles may initially/subsequently be used to capture and engage the beads to cause crushing of its spherical/box shape, and as the resulting fragments grow smaller, the longer length bristles may then act upon the fragments to cause further size reductions, until the desired particle size is reached.

It should be noted that other brush configurations may also be effectively utilized to initially crush the powder beads into smaller fragmented beads pieces. For example, the leading forward half of the brush (i.e., bristles being 90 degrees to either side of the leading edge point 37L) may undulate in length from one lateral side (+90 degrees) to the other later side (−90 degrees from the leading edge point 37L). Alternatively, the bristles of the leading forward half of the brush may follow a step shape, which may serve to initially engage the beads. In addition, even where each of the bristles may contact the first side 51 of the filter member 50 in the grinding chamber 10G, as seen in FIG. 14A, they may nonetheless serve to cause fragmenting of the beads where they are sufficiently fragile, merely through the agitation caused by the brush imparting movement to the beads therein. However, the tapered bristle lengths for the first brush, in causing some of the beads to be dragged within the chamber, may also thereby cause the fragments to scrape against the filter and thereby be ground down quickly, and to also be shaved by the openings in the filter, as the surface of the filter facing the grinding chamber is not flat.

The rotation arrow noted within FIG. 10 identifies the movement of the brush on the body housing relative to the filter member 50 in the body housing, and thus shows the brush's engagement with the beads it would encounter during the relative rotation. Therefore, it may be seen that when the user of the dispenser starts to cause rotation of the body housing 60 relative to the base housing 30, doing so in a counterclockwise fashion when looking down upon the base housing (opposite of arrow shown in FIG. 10), the grinder/sweeper brush 40 may not engage the powder beads 200, and instead, they may be generally pushed along within the grinding chamber 10G by the serpentine-shaped wall 38.

It should be noted that, as seen in FIGS. 1-3, a cylindrical bristle shield 70 may be installed to be concentric with respect to the cylindrical wall 63 and inner cylinder 66 of the body housing 60, prior to insertion of the bristle retaining ring 80 and bristles of brush 90. The bristle shield 70 may be slidably retained upon the body housing to be slidable between a retracted position (FIG. 2) and an extended position (FIG. 1), with the extended position being where a second end 72 of the bristle shield, during sliding from the first position, contacts and gathers the plurality of bristles of the second brush 90. The bristle shield 70 may thus serve to gather the bristles of the second brush 90 in order to more easily permit a cap 100 to be placed upon the body housing, without causing damage to the outermost of the periphery of bristles. The cap 100 may be threadably received by the body housing, or a friction fit may be used instead, or a detent arrangement may be used to secure the cap to the housing. The exposed portion of the cap may be knurled for easier gripping to accommodate its removal.

Figure 13:
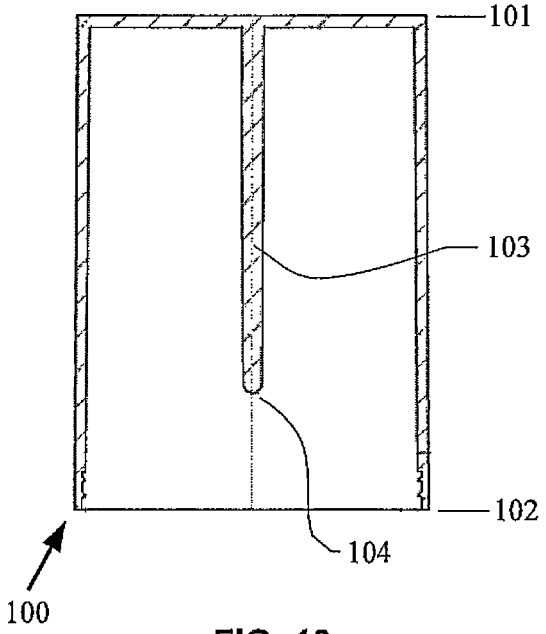
FIG. 13 is a cross-sectional view of the cap of FIG. 1.

It should also be noted that when the cap 100 (FIG. 13) is installed upon the dispenser 10, as seen in FIG. 1, an integral post 103 may extend away from the first end 101 of the cap toward its second end 102, with the tip 104 of the post being received within the delivery opening 69D of the body housing 60 to prevent the unnecessary expulsion therefrom, of powder stored in the delivery chamber. It lastly should be noted that the user of the device always maintains the option to grind and apply only as much powder as is roughly needed for a single application, or to grind an excess amount that may be retained within the delivery chamber, depending on the desire of the individual.

Figure 16A:
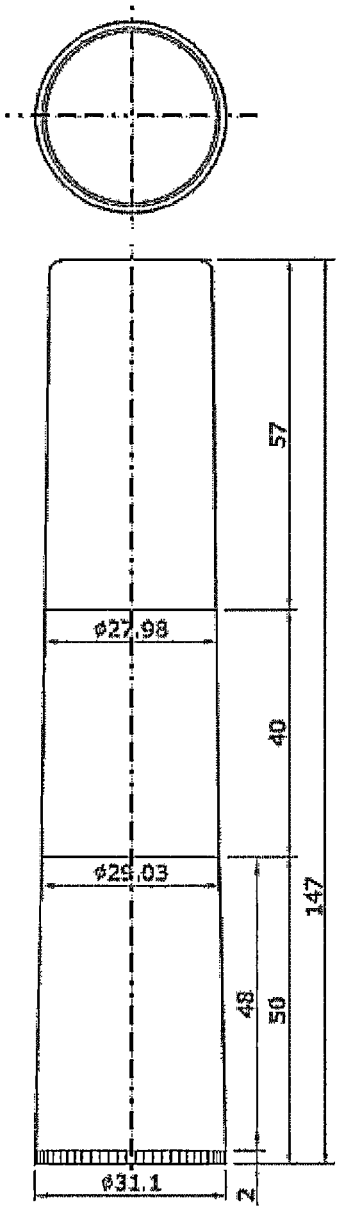
FIG. 16A-16C shows a variation in the size/shape of the parts of the dispenser shown in FIG. 1.
Figure 16B:
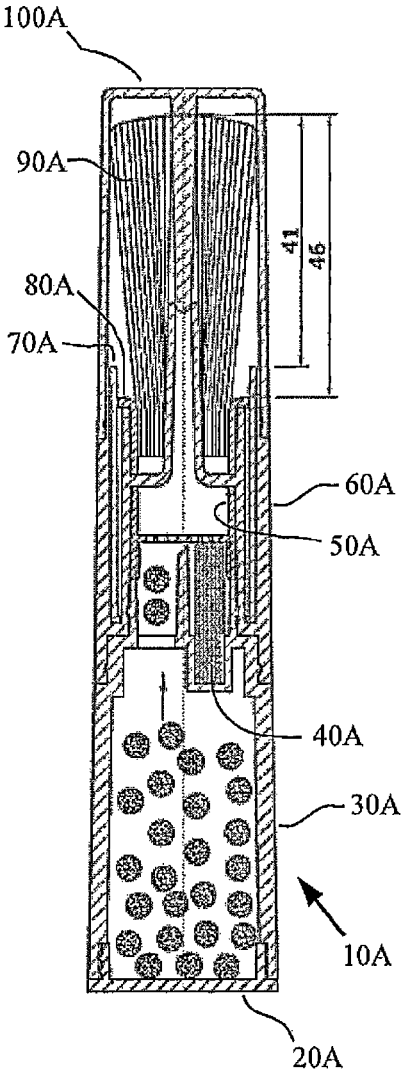
Figure 16C:
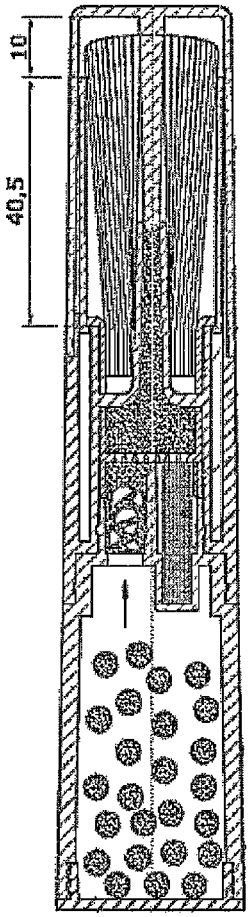
Figure 17A:
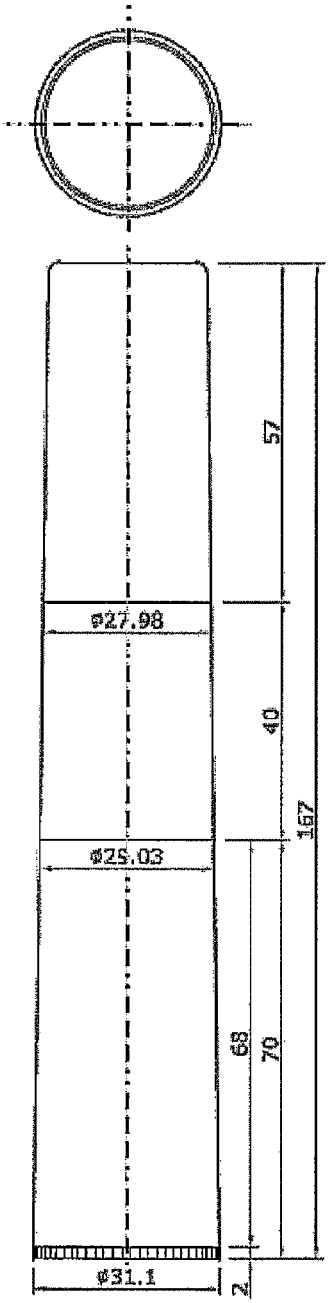
FIG. 17A-17C shows another variation in the size/shape of the parts of the dispenser shown in FIG. 1.
Figure 17B:
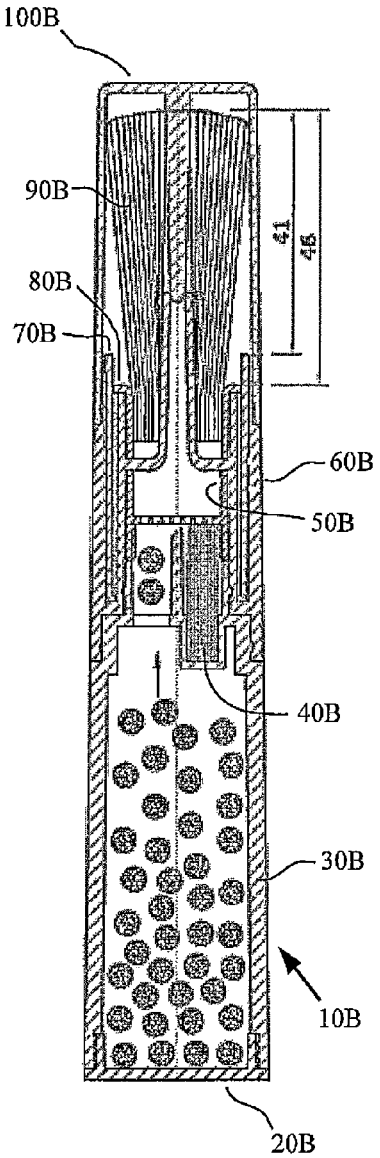
Figure 17C:
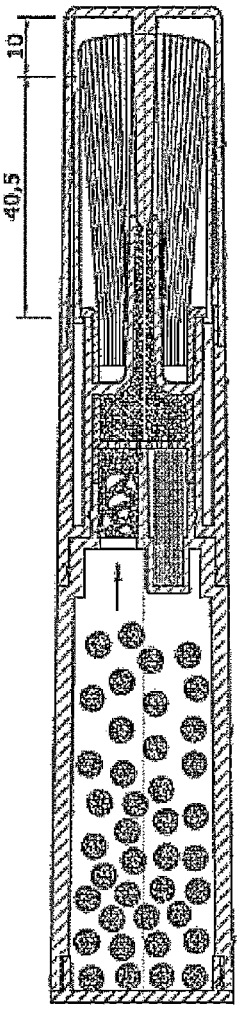
Figure 18A:
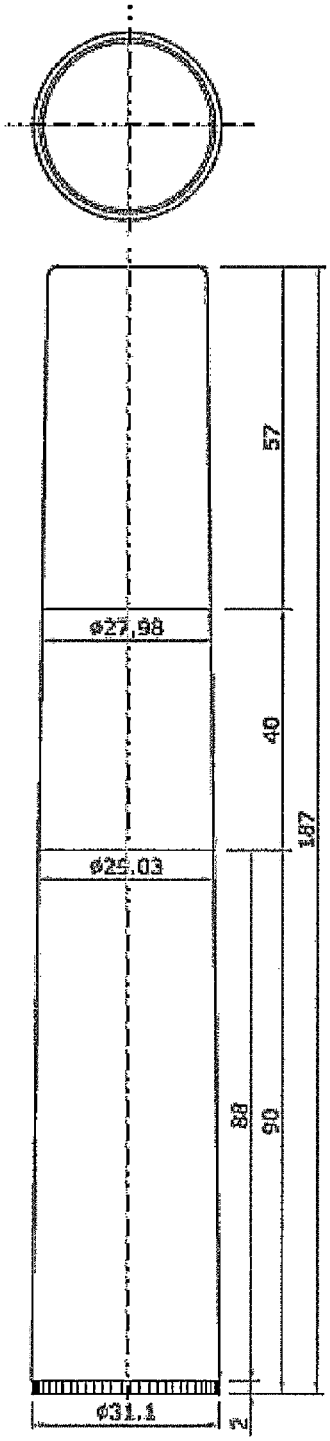
FIG. 18A-18C shows a variation in the size/shape of the parts of the dispenser shown in FIG. 1.
Figure 18B:
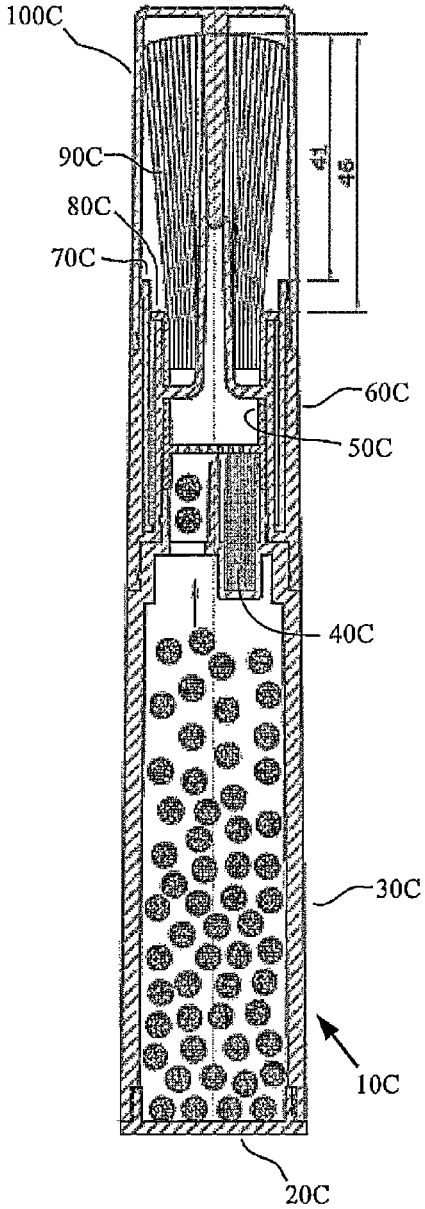
Figure 18C:
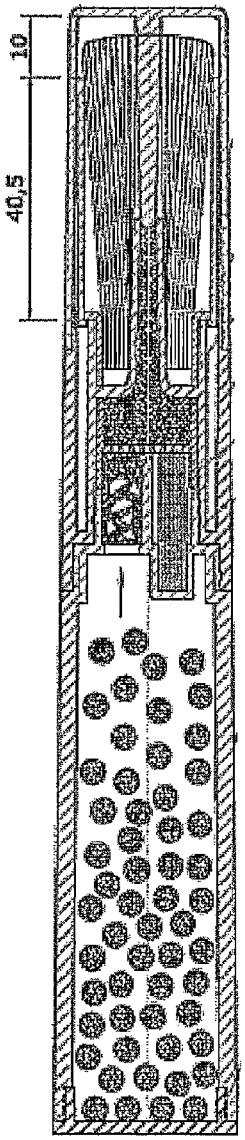

Variations in the size and shape of the dispenser 10 of the present invention that is shown in FIG. 1, may be seen within FIGS. 16A-16C for dispenser 10A, within FIGS. 17A-17B for dispenser the dispenser 10B, and within FIGS. 18A-18C for the dispenser 10C. Those variations may result in, for example, a longer base housing 30A (30B, and 30C), with greater storage space for the powder beads therein. In addition, as seen in FIGS. 16D-16E for dispenser 10A, the filter 50A may have a cylindrical periphery, as with filter member 50, but may instead have the generally flat plate portion 52A transected the cylinder. The length of the cylinder may be such that one end is generally proximate to the end of the base housing 30A, so that there is no exposed lip created by the cylinder of the filter member that could catch powder generated therein. In addition, the holes 54A in the flat plate portion 52A of the filter member may be conically shaped, so as to widen in moving away from the brush, which may serve to prevent compacting and jamming of the powder therein.

In an alternate embodiment of the present invention, the band member 44 that may be used to band together the plurality of bristles 43 (FIG. 3), may alternatively be rotatably received within the opening 37 in the recess 37R of the base housing (FIG. 12), rather than being fixedly secured therein. Also, the cylindrical opening 64 in the body housing 60 may have, as seen in FIG. 7, a plurality of grooves 65G positioned about its interior periphery, to form part of a modified planetary gear system, which may work in combination with corresponding grooves on the exterior periphery of the band member 44. (Note, the band member 44 in this embodiment would extend beyond the flat wall 35 of the base housing 30, as seen in FIG. 2, and this outwardly extending portion of the band member would be grooved and positioned to engage the corresponding grooves 65G on the body housing 60). Therefore, when the body housing 60 is rotated relative to the base housing 30, not only may the brush thereby rotate about the rotational axis of the two housing members, but it may also be driven by the modified planetary system to additionally rotate about its mounting axis within recess 37R of the base housing. This additional rotation of the brush 40 about its mounting axis may further contribute to the crushing and grinding down of the power beads into powder particles of the desired size, as it may drive the beads into contact with the walls of the housing. (Note, the arrangement is termed a modified planetary gear system, because in a typical planetary gear system, there is a central "sun gear," which is not utilized herein, as it is not needed).

Figure 15:
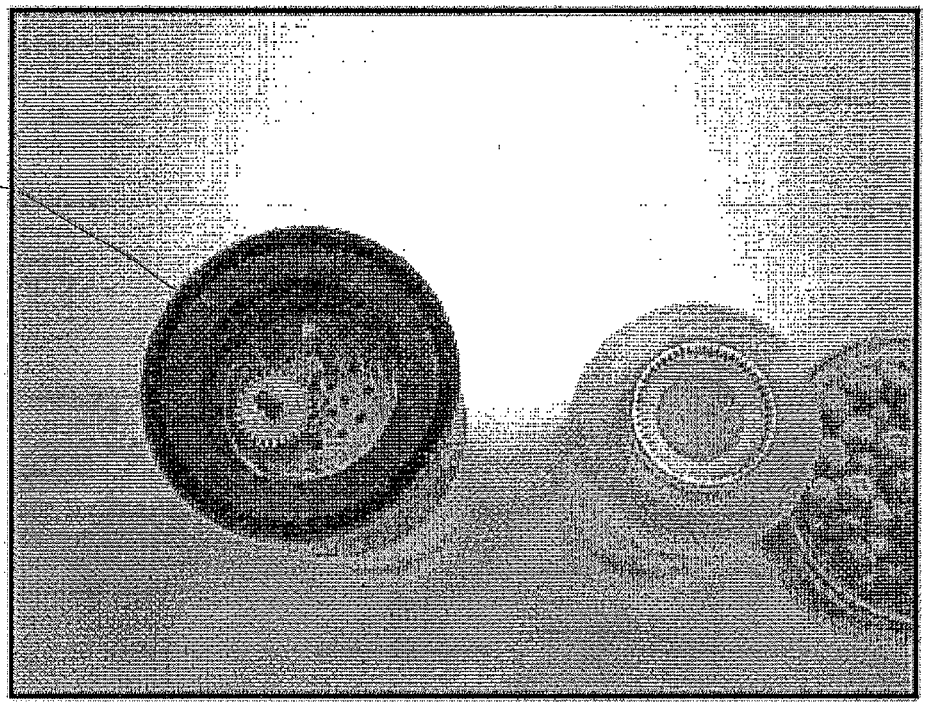
FIG. 15 shows an alternate embodiment of the present invention.

In yet another alternate embodiment, seen in FIG. 15, a similar planetary system may be used to cause a gear 444 to rotate, and the rotating gear itself may be used to cause the grinding of the powder beads.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. An apparatus, for use in a brushed application of a cosmetic powder, said apparatus comprising:

a base housing, said base housing having a first end and a second end, said base housing comprising a cavity and an opening at said second end into said cavity;

a first brush comprising a plurality of bristles, a first end of said bristles being fixedly secured proximate to a portion of said second end of said base housing, for said plurality of bristles to protrude away from said base housing;

a filter member, said filter member comprising a plurality of selectively sized holes;

a body housing, said body housing comprising a first opening into a chamber therein, and a delivery opening into said chamber; said body housing configured to fixedly receive said filter member in said chamber to divide said chamber into a delivery chamber and a grinding chamber, said delivery chamber being proximal to said delivery opening, and said grinding chamber being proximal to said first opening;

a second brush, said second brush comprising a plurality of bristles being fixedly secured peripherally about said delivery opening of said body housing;

wherein said second end of said base housing is rotatably mounted to said body housing, with said plurality of bristles of said first brush configured to extend into said grinding chamber for a second end of said bristles to be in proximity to said filter member; and wherein rotation of said base housing relative to said body housing causes rotation of said bristles of said first brush in said grinding chamber relative to said filter member, for use in reducing powder beads into particles forming a cosmetic powder being small enough to pass through said selectively sized filter holes.

2. The apparatus according to claim 1 wherein said second end of said plurality of bristles of said first brush are tapered in length from a first side of said first brush to a second side of said first brush, and wherein said plurality of bristles of said first brush are fixedly secured to said portion of said second end of said housing to have a gradient of said tapered bristle lengths be generally orthogonal to a direction of the rotation of said rotatable base housing.

3. The apparatus according to claim 2 wherein said bristles of said first brush are configured to extend such that said second end of said bristles contact said filter member.

4. The apparatus according to claim 3 wherein said first brush is fixedly secured proximate to said portion of said second end of said base housing, with an axis of said first brush configured to be offset from an axis of rotation for said rotatable mounting of said base housing to said body housing.

5. The apparatus according to claim 4 further comprising a serpentine-shaped stiffener on said second end of said base housing, said serpentine-shaped stiffener extending into a portion of said grinding chamber to be proximate to said filter member but displaced therefrom; a first side of said serpentine-shaped stiffener curving around said first brush, and a second side of said serpentine-shaped stiffener curving around said opening at said second end of said base housing.

6. The apparatus according to claim 5 further comprising a bristle retention sleeve, said bristle retention sleeve configured to secure said plurality of bristles of said first brush relative to said body housing.

7. The apparatus according to claim 6 wherein said body housing further comprises a conical delivery chute between said delivery chamber and said delivery opening.

8. The apparatus according to claim 7 wherein said base housing comprises an opening at said first end, and a bottom cover member configured to be releasably secured thereto using a securing means.

9. The apparatus according to claim 8 further comprising a bristle shield, said bristle shield being slidably mounted upon said body housing to be slidable between a first position and a second position, said first position being a retracted position, said second position being an extended position wherein a first end of said bristle shield, during said sliding, contacts and gathers said plurality of bristles of said second brush.

10. The apparatus according to claim 9 further comprising a cap, said cap being releasably securable upon said body housing using a cap securing means; and wherein said cap comprises an integral post extending away from an end of said cap, said post being received within said delivery opening of said body housing when said cap is secured upon said body housing.

11. The apparatus according to claim 10 wherein said plurality of selectively sized holes of said filter comprise holes having a diameter of 1 mm or smaller.

* * * * *